US006968254B2

(12) United States Patent
Tochigi et al.

(10) Patent No.: US 6,968,254 B2
(45) Date of Patent: Nov. 22, 2005

(54) FEEDBACK CONTROLLED TENSION APPLYING SYSTEM

(75) Inventors: Kenji Tochigi, Nakano-ku (JP); Hirokazu Yaezawa, Nakano-ku (JP); Kimio Nozaki, Nakano-ku (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/760,507

(22) Filed: Jan. 21, 2004

(65) Prior Publication Data

US 2004/0153194 A1 Aug. 5, 2004

(30) Foreign Application Priority Data

Jan. 22, 2003 (JP) ..... 2003-013917

(51) Int. Cl.[7] ..... G06F 19/00; B23Q 15/00; B23Q 16/00; B65H 26/00; B65H 43/08

(52) U.S. Cl. ..... 700/122; 226/24

(58) Field of Search ..... 700/122; 226/24, 226/42

(56) References Cited

U.S. PATENT DOCUMENTS

| | | | | | |
|---|---|---|---|---|---|
| 4,775,086 | A | * | 10/1988 | Kataoka | 226/44 |
| 5,146,847 | A | * | 9/1992 | Lyon et al. | 100/2 |
| 5,813,587 | A | * | 9/1998 | Nordgren | 226/29 |
| 5,819,575 | A | * | 10/1998 | Kobayashi et al. | 72/187 |
| 6,038,967 | A | * | 3/2000 | Chak et al. | 100/2 |
| 6,301,862 | B1 | * | 10/2001 | Yuyama et al. | 53/562 |

* cited by examiner

*Primary Examiner*—Leo Picard
*Assistant Examiner*—R Jarrett
(74) *Attorney, Agent, or Firm*—Wenderoth, Lind & Ponack, L.L.P.

(57) ABSTRACT

A feedback controlled tension applying system includes a corrugated fin processing device that processes a fin material in continuous sheet form while applying a tension to the fin material. A tension applying device applies the tension to the fin material. An encoder measures a moving amount of the fin material, and a control device that feedback-controls the tension applying device based on a measurement result of the encoder so that the moving length amount per predetermined time of the material becomes a set value that is set in advance.

4 Claims, 2 Drawing Sheets

FEEDBACK CONTROLLED TENSION APPLYING SYSTEM

BACKGROUND OF THE INVENTION

1. Field of the Invention

The present invention relates to a feedback controlled tension applying system for supplying a material in continuous sheet form to a material processing device while applying a tension, which is controlled to be an appropriate value, to the material.

2. Description of the Related Art

The conventional feedback controlled tension applying system of this type is disclosed in Japanese Patent Laid-open No. 2002-102938. This feedback tension applying system is applied to a corrugated fin processing device for manufacturing corrugated fins for automotive heat exchangers and includes a slit processing device that separates a continuously supplied fin material in sheet form into two rows, a corrugation processing device that processes the fin material separated into two rows in a longitudinal direction into corrugated form, a tension applying device that is arranged in the upstream side or down stream side of the slit processing device and applies a tension to the fin material, and a load cell that measures the tension by measuring a reaction force that acts on tension measuring rolls, which press the fin material placed between two support rolls, in order to control the tension applying device.

The tension applying device is then feedback-controlled so that a load value measured by the load cell becomes a set value that is set in advance. While applying a predetermined tension to the fin material, the fin material is controlled so that a supplying length of the fin material to the slit processing device and to the corrugated fin processing device becomes a predetermined length.

However, in the above-described conventional feedback controlled tension applying system, the value of appropriate tension to be applied to the material changes in each case according to processing accuracy of the corrugated fin processing device and the type or kind of fin material, so that, when attempting to control the supplying length of the fin material to the corrugated fin processing device to be a predetermined length, a load of the load cell corresponding to the predetermined length is needed to be changed in each case. Therefore, there has been a problem that considerable time and work are needed to set or adjust the set value of the tension that is set in advance.

Further, the tension of the fin material that is applied by the tension applying device is a substitute value for a supplying length amount per predetermined time, for example per unit time, of the fin material to be supplied to the corrugated fin processing device (corresponding to supplying speed of the fin material), and when the tension applying device is feedback-controlled based on a measurement result, not a moving length amount per predetermined time but a load, of the load cell, there has been a problem in that, if dispersion in height, length, louver angle or the like of a processed corrugated fin occurs, it is difficult to identify a cause of the dispersion.

Furthermore, since the tension applying device uses frictional forces of felt pads that sandwich the fin material as a method for applying a tension to the fin material, there has been a possibility of product variation caused by a change of coefficient of dynamic friction of the fin material, a rapid increase of load to the fin material when the corrugated fin processing device transit from a halt state to an operating state, or the like.

The present invention is made in view of the above described problems, and an object thereof is to provide a feedback controlled tension applying system that is capable of easily changing a setting of control to make the length per unit time of the material supplied to the material processing device become a predetermined value when the processing accuracy of the material processing device or the type or kind of a fin material are changed when supplying a material in continuous sheet form to the material processing device while applying a tension to the material, and is capable of improving the precision of products processed by the material processing device.

SUMMARY OF THE INVENTION

In order to achieve the object stated above, a feedback controlled tension applying system according to the present invention comprises a material processing device that processes a material in continuous sheet form while applying a tension to the material, a tension applying device that applies the tension to the material, a measuring means for measuring a moving length amount per predetermined time of the material and a control device that feedback-controls the tension applying device based on a measurement result of the measuring means so that the moving length amount per predetermined time of the material becomes a set value that is set in advance.

Therefore, in the feedback controlled tension applying system according to this embodiment, the tension applying device is feedback-controlled based on the measurement result of the measuring means, which measures the moving length amount per predetermined time of the material, so that the moving length amount per predetermined time of the material becomes the set value that is set in advance. Thus, as compared to the case similar to the above-described conventional art in which the tension load of the material is measured for controlling the moving length amount per predetermined time of the material, the control of moving length amount per predetermined time of the material can be easily changed in order to supply the material having a predetermined length amount per predetermined time to the material processing device when the processing accuracy of the material processing device or the type or kind of the fin material changes. As a result, the supply length amount per predetermined time of the material can be controlled to improve product precision of the material processing device.

Preferably, the measuring means comprises a measuring roll that rotates in contact with the material and an encoder that detects an amount regarding a rotation angle of the measuring roll. The measuring means measures the moving length amount per predetermined time of the material based on the amount regarding the rotation angle of the measuring roll detected by the encoder.

Therefore, in this feedback controlled tension applying system, it becomes possible to measure the moving length amount per predetermined time of the material by using the measuring roll and the encoder, so that the control of moving (supply) length amount per predetermined time of the material to the material processing device can be easily changed, and the product precision of the processing device can be improved.

Preferably, in the feedback controlled tension applying system, the tension applying device comprises: a base; an arm having one and other end portions thereof, the one end portion of the arm being fixed to the base so as to be swingable in upward and downward directions and the other end portion of the arm being provided with a pulley that applies a load on the material, and a balance weight that moves on the arm in opposite directions along the arm by control of the control device.

Therefore, in this feedback controlled tension applying system, the tension applying means has the arm whose one end portion is fixed to the base so as to be swingable in the upward and downward directions and the other end portion provided with the pulley that applies a load on the material. The balance weight that moves on the arm by control of the control device, so that an adjusted tension can be applied on the material through the pulley by moving the balance weight on the arm, and thus the tension on the material can be easily set in a very small unit and finely adjusted.

Further, since the tension is applied on the material through the pulley, it is not necessary, as compared to the tension by frictional force of a pad, to consider the change of coefficient of dynamic friction that is different on each material, the abrasion of the pad, and the like.

Preferably, in the feedback controlled tension applying system, the processing device performs processing in a longitudinal direction of the material.

Therefore, in this feedback controlled tension applying system, since the processing device performs processing in the longitudinal direction of the material, it is possible to control a supplying amount per predetermined time of the material in the longitudinal direction thereof, which is most important when the material processing device processes a material.

DETAILED DESCRIPTION OF THE PREFERRED EMBODIMENTS

Hereinafter, a feedback controlled tension applying system according to an embodiment of the present invention will be described with reference to the attached drawings.

The feedback controlled tension applying system according to this embodiment is here applied to a corrugated fin processing device for manufacturing corrugated fins of automotive heat exchangers such as condensers and radiators.

Figure 1:
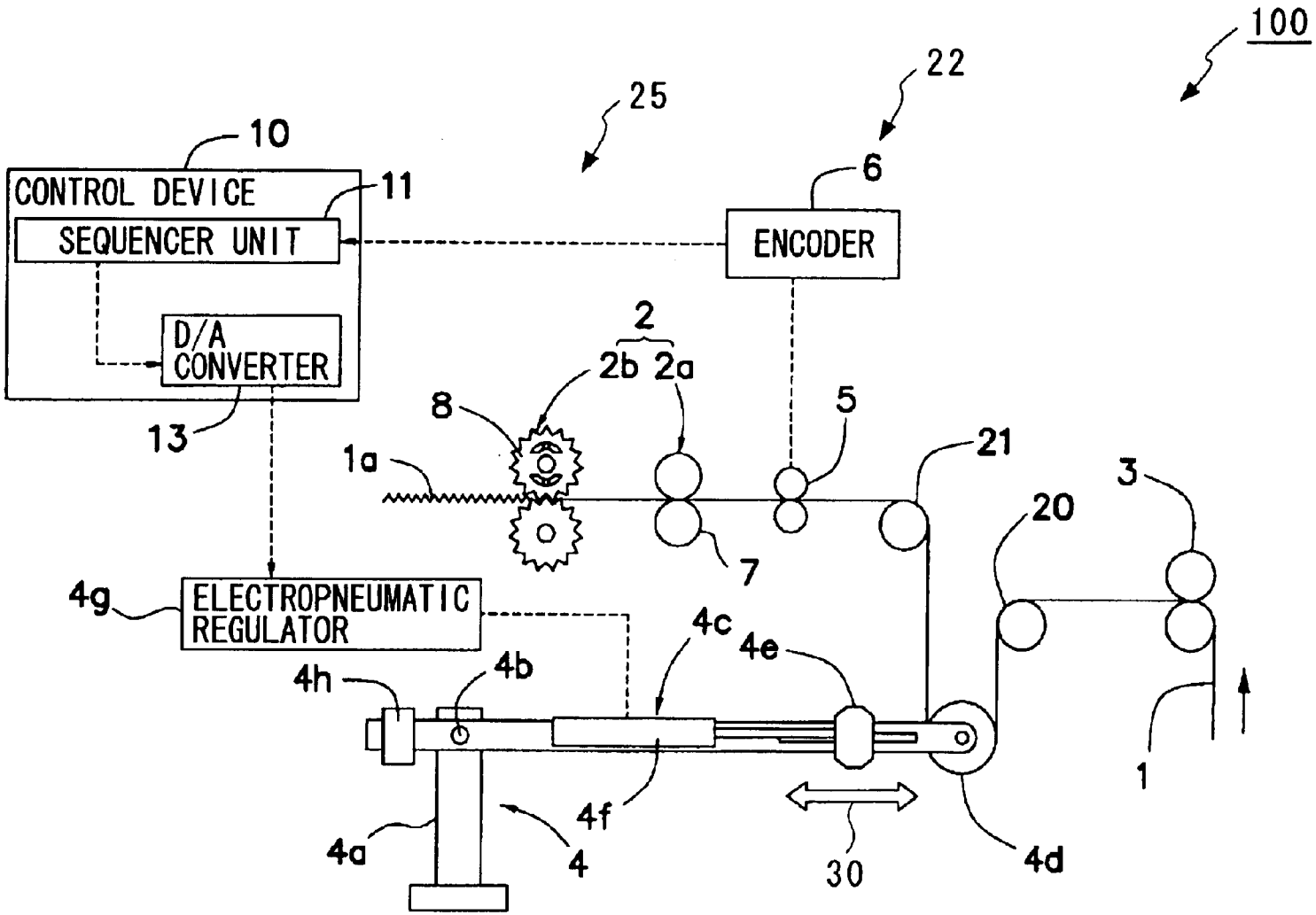
FIG. 1 is a schematic view showing a feedback controlled tension applying system according to an embodiment of the present invention.
Figure 2:
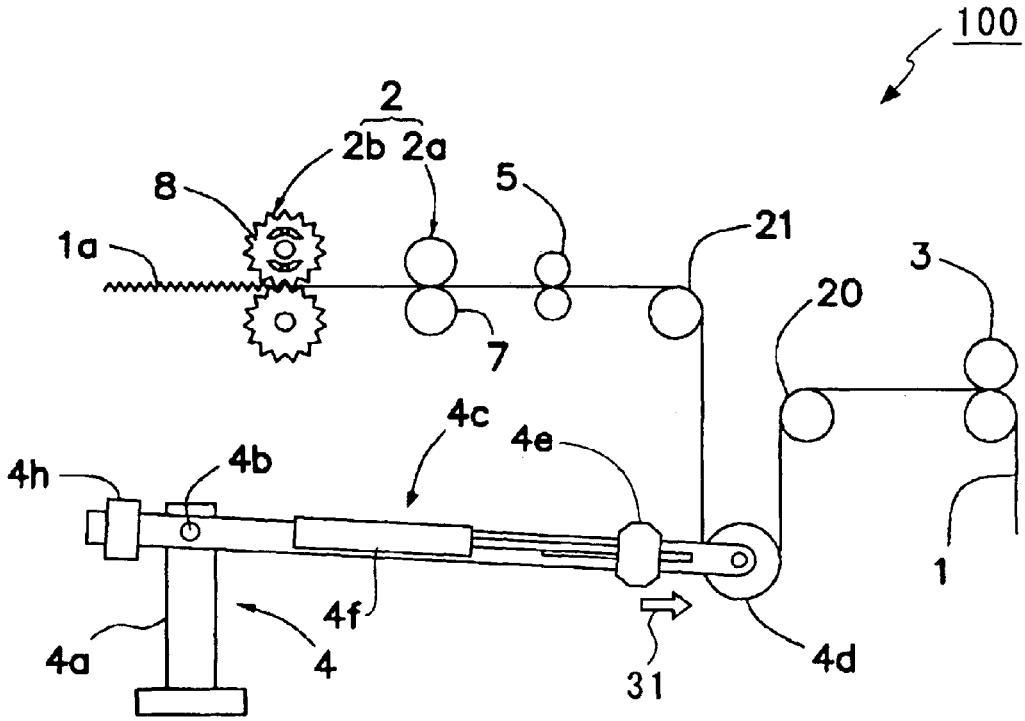
FIG. 2 is a view describing operation of the feedback controlled tension applying system according to the embodiment when a moving length amount per predetermined time of a fin material per unit time exceeds a set value.

FIG. 1 is a schematic view of the feedback controlled tension applying system 100 according to the embodiment of the present invention, and FIG. 2 is a view describing operation of the feedback controlled tension applying system 100 according to this embodiment.

As shown in FIG. 1, the feedback controlled tension applying system 100 according to the embodiment of the present invention has a corrugated fin processing device 2 that processes a continuously supplied fin material 1 in sheet form, a pair of free dump rolls 3 that supply the fin material 1 to the downstream side of the feedback controlled tension applying system 100, a tension applying device 4 that applies a tension to the fin material 1, and a control system 25 that controls the tension applying device 4.

The corrugated fin processing device 2 is constituted of a slit processing device 2*a* that separates the fin material 1 in two rows along a moving direction of the fin material 1 by a pair of cutters 7, and a corrugation processing device 2*b* that corrugates the fin material 1, which is separated in two, by a pair of corrugate cutters 8. The corrugated fin processing device 2 functions as a material processing unit of the present invention.

The control system 25 includes a measuring unit 22 that detects a moving length amount per predetermined time of the fin material 1, a control device 10 that inputs a signal regarding the moving length amount per predetermined time of the fin material 1 measured by the measuring means 22 and outputs a control signal, and an electropneumatic regulator 4*g* that adjusts a supplying air amount based on the control signal outputted from the control device 10.

The measuring unit 22 includes a pair of measuring rolls 5 that sandwiches the fin material 1 and rotates in association with a movement of the fin material 1, and an encoder 6 that detects an rotation angle of the measuring rolls 5 and outputs a signal regarding the moving length per unit time of the fin material 1 based on the rotation angle of the measuring roll 5 detected by the encoder 6. The control device 10 has a sequencer unit 11 that receives an inputs of the signal regarding the moving length amount per predetermined time of the fin material 1 detected by the encoder 6 and outputs a digital control signal obtained by comparing the signal regarding the moving length amount per predetermined time of the fin material 1 with a set value that is set in advance and calculating the moving length amount per predetermined time of the fin material 1 to match the set value, and a D/A converter 13 that converts the digital control signal outputted from the sequencer unit 11 into an analogue control signal and outputs the analogue control signal to the electropneumatic regulator 4*g*.

The electropneumatic regulator 4*g* supplies a supplying air amount to an air cylinder 4*f* of the tension applying device 4 according to the analogue control signal inputted from the control device 10.

Next, the tension applying device 4 will be described.

The tension applying device 4 has a base 4*a* that is placed on the floor, not shown, and extends in a direction perpendicular to the flower, and an arm 4*c* whose one end portion is swingably fixed on a pivot 4*b* provided on the top end of the base 4*a*.

On the other end portion of the arm 4*c*, a pulley 4*d* is rotatably provided. On a portion of the arm 4*c* in the vicinity of the pulley 4*d*, a balance weight 4*e* is provided to be movable along and lockable on the arm 4*c*.

The balance weight 4*e* is coupled to the piston rod of a piston, not shown, movable in the air cylinder 4*f*, and moves in opposite directions on the arm 4*c* following extension and contraction of the piston rod relative to the air cylinder 4*f* controlled by the control device 10, and thereafter locks at a desirable position.

Incidentally, a flow amount of air for driving the piston supplied to the air cylinder 4*f* is controlled by the electropneumatic regulator 4*g*.

Further, a fixed balance weight 4*h* for balancing the arm 4*c* is attached on the one side portion of the arm 4*c*.

Hereinafter, operation of the feedback controlled tension applying system 100 according to the present invention will be described.

In the feedback controlled tension applying system 100 according to this embodiment, the fin material 1 supplied from the free dump rolls 3 to the downstream side thereof is guided through a fixed pulley 20 to the pulley 4*d* of the tension applying device 4, and then the fin material 1 is guided in a state that a downward load is applied thereon through a fixed pulley 21 to the measuring rolls 5.

Furthermore, the fin material 1 is guided through the measuring rolls 5 to the slit processing device 2*a* and the corrugation processing device 2*b*, and appropriate processes are performed therethrough such as separating the fin material 1 in two rows along its longitudinal direction, corrugating the fin material 1, and the like to thereby form a corrugated fin 1*a*.

Incidentally, while moving and processing the above-described fin material 1, in the control device 10, the sequencer unit 11 takes in the result of measuring the rotation angle of the measuring rolls 5 measured by the encoder 6.

In the sequencer unit 11, the moving length amount per predetermined time of the fin material 1 is calculated based on the measurement result of the encoder 6, the moving length amount per predetermined time of the fin material 1 is compared with a set value that is set in advance, and a digital control signal obtained by calculating the moving length amount per predetermined time of the fin material 1 to match the set value is converted by the D/A converter 13 into an analogue control signal so as to control the electropneumatic regulator 4*g*, thereby adjusting the air flow amount to be supplied to the air cylinder 4*f*.

The electropneumatic regulator 4*g* adjusts the air flow amount in the air cylinder 4*f* to extend or contract the piston rod with relative to air cylinder 4*f* according to the analogue control signal. As a result, the balance weight 4*e* appropriately moves in a right and left directions on the arm 4*c*, thereby applying a predetermined tension to the fin material 1 through the pulley 4*d* of the arm 4*c*.

For example, as shown in FIG. 2, when the moving length amount per predetermined time of the fin material 1 exceeds the set value, the air flow amount of the air cylinder 4*f* is increased so as to extend the piston rod of the air cylinder 4*f* toward the right side in the figure, and thereby the balance weight 4*e* is moved on the arm 4*c* in a direction of arrow 31 so as to rotate the end portion on the other side of the arm 4*c* in the downward direction, so that a larger force in the downward direction acts on the fin material 1 between the fixed pulley 20 and the fixed pulley 21.

As a result, the pulley 4*d* increases the tension in a longitudinal direction, namely, the moving direction of the fin material 1, so that the moving length amount per predetermined time of the fin material 1 to the downstream side is restrained in a direction to be small. Further, when the moving length amount per predetermined time of the fin material 1 is equal to or less than the set value, the balance weight 4*e* is moved so as to decrease the tension contrary to the above-mentioned case, thereby increasing the moving length amount per predetermined time of the fin material 1.

Incidentally, the free dump rolls 3 are controlled in such a manner that the supply length amount per predetermined time of the fin material 1 to the pulley 4*d* is appropriately controlled by a control device, not shown, to provide an appropriate moving range of the pulley 4*d* of the tension applying device 4.

Then, the control device 10 feedback-controls the tension applying device 4 based on the measurement result of the encoder 6 so that the moving length amount per predetermined time of the fin material 1 always becomes the set value that is set in advance, and adjusts the tension on the fin material 1 in real time.

Therefore, in the feedback controlled tension applying system 100 according to this embodiment, the moving length amount per predetermined time of the fin material 1 is measured by the encoder 6 and the tension on the fin material 1 is adjusted while feedback-controlling the tension applying device 4 based on the measurement result thereof, so that, when processing accuracy of the corrugate cutters 8 or the type or kind of the fin material 1 is changed, the moving length amount per predetermined time of the fin material 1 can be easily changed to supply a predetermined length amount per predetermined time of the fin material 1 to the corrugated fin processing device 2, thereby realizing formation of the corrugated fin 1*a* with high product precision.

Further, as compared to the conventional art, it is not necessary to consider the change of coefficient of dynamic friction or the like that is different on each fin material, so that the set value of the moving amount of the fin material 1 can be easily set or adjusted, and also the cause of an obstruction can be easily identified when it occurs.

The feedback controlled tension applying system according to the embodiment of the present invention has been described above, but the specific structure of the present invention is not limited to the above-described embodiment. The present invention includes any change in design without departing from the gist of the invention.

For example, in this embodiment, the example of the feedback controlled tension applying system 100 applied to the corrugated fin processing device 2 for heat exchangers has been described, but the invention is not limited to this, and it is needless to mention that the invention can be applied to, for example, a general roll forming device.

The entire contents of Japanese Patent Application Tokugan 2003-013917 (filed Jan. 22, 2003) are incorporated herein by reference.

What is claimed is:

1. A feedback controlled tension applying system, comprising:

a material processing device operable to process a material in a continuous sheet form while tension is applied to the material;

a tension applying device operable to apply the tension to the material;

a measuring device operable to measure a moving length amount of the material over time; and a control device operable to feedback-control the tension applying device based on a measurement result of said measuring device so that said tension applying device increases the tension applied to the material when the moving length amount of the material over time exceeds a set value that has been set in advance and said tension applying device decreases the tension applied to the material when the moving length amount of the material over time falls below the set value;

wherein said measuring device comprises:

a measuring roll that rotates in contact with the material; and an encoder that is operable to detect an amount regarding a rotation angle of said measuring roll;

wherein said measuring device is operable to measure the moving length amount of the material over time based on the amount regarding the rotation angle of said measuring roll detected by said encoder; and wherein said tension applying device comprises:

a base;

an arm having end portions, wherein one of said end portions is fixed to said base so as to be vertically swingable and another of said end portions has a pulley for applying a load to the material; and a balance weight movable on said arm in opposite directions along said arm under the control of said control device.

2. The system of claim 1, wherein said material processing device is operable to process the material in a longitudinal direction of the material.

3. A feedback controlled tension applying system, comprising:

a material processing device operable to process a material in a continuous sheet form while tension is applied to the material;

a tension applying device operable to apply the tension to the material;

a measuring device operable to measure a moving length amount of the material over time; and a control device operable to feedback-control the tension applying device based on a measurement result of said measuring device so that said tension applying device increases the tension applied to the material when the moving length amount of the material over time exceeds a set value that has been set in advance and said tension applying device decreases the tension applied to the material when the moving length amount of the material over time falls below the set value;

wherein said tension applying device comprises:

a base;

an arm having end portions, wherein one of said end portions is fixed to said base so as to be vertically swingable and another of said end portions has a pulley for applying a load to the material; and a balance weight movable on said arm in opposite directions along said arm under the control of said control device.

4. The system of claim 3, wherein said material processing device is operable to process the material in a longitudinal direction of the material.

* * * * *